US007669651B1

(12) United States Patent
Carstensen

(10) Patent No.: US 7,669,651 B1
(45) Date of Patent: Mar. 2, 2010

(54) APPARATUS AND METHOD FOR MAXIMIZING PRODUCTION OF PETROLEUM WELLS

(76) Inventor: Kenneth J. Carstensen, P.O. Box 8728, Houston, TX (US) 77249

( * ) Notice: Subject to any disclaimer, the term of this patent is extended or adjusted under 35 U.S.C. 154(b) by 239 days.

(21) Appl. No.: 12/073,163

(22) Filed: Feb. 29, 2008

Related U.S. Application Data

(60) Provisional application No. 60/904,289, filed on Mar. 1, 2007.

(51) Int. Cl.
*E21B 43/00* (2006.01)

(52) U.S. Cl. ..... 166/105; 417/43; 417/44.1; 417/63

(58) Field of Classification Search ..... 166/105, 166/66, 64, 68; 417/43, 44.1, 63
See application file for complete search history.

(56) References Cited

U.S. PATENT DOCUMENTS 5,230,607 A * 7/1993 Mann ..... 417/12
5,406,482 A * 4/1995 McCoy et al. ..... 702/6
2005/0158179 A1* 7/2005 Medizade et al. ..... 417/53
2009/0114396 A1* 5/2009 Kusko et al. ..... 166/373

* cited by examiner

*Primary Examiner*—David J Bagnell
*Assistant Examiner*—James G Sayre
(74) *Attorney, Agent, or Firm*—Jones, Tullar & Cooper, P.C.; Raymond A. Bogucki

(57) ABSTRACT

The level of petroleum accumulating from a production zone as it is pumped from a lower elevation in a wellbore is remotely monitored by using the energy of a sucker rod driven pump. One or more sensors are interposed between sections of the sucker rod between the production zone and the pump level. The sensors include trigger mechanisms moving with the sucker rod string within spring loaded and slidable pistons. Over a short span the reciprocating triggers engage deformable sleeve actuators which slide and spring load the pistons. When the triggers pass through the sleeve actuators, they release the piston which impacts against a pressure wave or sonic signal generator. The impacted elements transmit a signal up to the wellhead indicative of the presence or absence of petroleum at that elevation. One or two sensors, and optionally other inputs as well, can be used in adjusting the pumping rate to maximize production.

21 Claims, 9 Drawing Sheets

APPARATUS AND METHOD FOR MAXIMIZING PRODUCTION OF PETROLEUM WELLS

REFERENCE TO PRIOR ART

This application is based on previously filed Provisional Application Ser. No. 60/904,289 filed Mar. 1, 2007 by Kenneth J. Carstensen and entitled "APPARATUS AND METHOD FOR MAXIMIZING PRODUCTION OF PETROLEUM WELLS".

FIELD OF THE INVENTION

This invention relates to the problem of extracting maximum practical flow of formation fluid containing petroleum from oil wells which require the use of pumping equipment to lift the formation fluid from a production zone to the surface.

BACKGROUND OF THE INVENTION

In most petroleum wells heretofore, and increasingly as petroleum reserves are depleted, petroleum must be withdrawn from an oil producing formation zone of a well by mechanical lifting equipment driven by a motive source at the surface, which is either of the reciprocating or rotary type. In a typical installation, the motive source at the surface comprises, in the case of a reciprocating pump, an electrically driven pump jack, and in the case of a rotary type pump, an electrically driven rotary drive.

In a typical configuration of an oil well, a hole or wellbore is drilled from the surface to a depth somewhat below a geological formation that bears petroleum. Inside this wellbore and extending the full depth of the wellbore a string of pipe is installed that is referred to as casing, consisting of segments of threaded pipe serially connected by couplers. The annulus between the casing and the surrounding earthen wall of the drilled wellbore is filled with cement, and as such, the casing is installed on a permanent basis. At the surface the casing is connected to a wellhead, an apparatus of various connections, valves, and seals, as well as the pump driving system whereby the several operations of the well are isolated and managed by the operator.

At that depth where the casing passes through the oil bearing geological formation, the casing and the cement enclosing it are perforated to allow fluid to flow from the formation into the casing. Within the casing is installed a second smaller diameter string of pipe referred to as tubing. Like the casing, the smaller diameter tubing consists of segments of end threaded pipe connected one to another and extends from the wellhead to the depth at which the pump is installed, near the bottom of the wellbore and casing, and usually below the perforations. At the end of the tubing the pump is installed, an elongated multi-component apparatus which is approximately 30 feet in length, and has a fluid intake element located at its bottom. The pump, be it of the reciprocating type or the rotational type, is powered from the surface by either a pump jack or a rotary drive, with power being transferred down the wellbore to the pump by a sucker rod string. A sucker rod string consists of lengths of solid steel rods threaded on each end and connected one to another with threaded couplings. In the case of a reciprocating type pump, the sucker rod string is attached at the surface to the pump jack, from which point it runs down the inside of the tubing to the plunger element of the reciprocating pump. The pump jack at the surface cyclically lifts and lowers the sucker rod string which in turn lifts and lowers the plunger of the pump below.

In the case of rotary type pumps, the rotary drive at the surface rotates the sucker rod string which is attached to and rotates the rotor element of the rotary pump at the bottom of the well. As either the plunger element of the reciprocating pump cycles up and down or the rotor element of the rotational pump rotates, fluid is pumped up the annulus between the sucker rod string and the tubing to the surface.

Fluid from the oil bearing formation flows through the perforations in the casing and into the annulus between the casing and the smaller tubing. As the pump operates, fluid is drawn into the pump from the annulus between the tubing and the sucker rod string and pumped up the tubing to the wellhead. At the wellhead the fluid branches off to a flowline and is delivered to a storage tank or other facility.

In any well that utilizes any form of pumping apparatus to lift the formation fluid to the surface, long term production is optimized if the rate at which the pump evacuates the fluid to the surface is equal to the rate at which the fluid flows from the formation through the perforations into the well. Due, however, to constantly changing and unpredictable formation flow rates in combination with the shortcomings of existing monitoring equipment, this balance is rarely attained.

To best cope with this situation a procedure involving on-off sequencing of the pumping operation is most frequently employed. In this procedure the pump is allowed to pump at a pace exceeding the formation flow rate until it has emptied the well of fluid. At that point, in the case of reciprocating plunger pumps, the plunger draws a large amount of air rather than fluid into the pump barrel on its upstroke, and then, without the normal cushioning resistance of fluid, pounds forcefully into the air/fluid interface in the barrel on the downstroke. This pounding greatly stresses and ultimately will damage numerous elements of the pump apparatus including the sucker rod string, the barrel and plunger of the pump, the gearbox, motor, and structural components of the pump jack, and to a lesser extent the tubing string.

This condition is referred to in the industry as being "Pumped Off" and pumps are typically equipped with a sensor that detects the shock waves resultant from the Pumped Off condition when it occurs. That particular sensor and the related equipment is known as a Pump Off Controller or POC, which is programmed to automatically shut down the pump jack when it identifies the Pumped Off condition.

The POC is further programmed to, after a pre-set period of time, turn the pump jack back on whereby pumping can resume. The pre-set period of time is set by the operator and is intended to be long enough to allow the formation flow to refill the well to a level that provides a practical reservoir of pump-available fluid.

Dependent on the particular well characteristics, this on/off cyclic pumping method may be programmed to cycle as frequently as six times per hour. Several disadvantages are inherent in this procedure.

Due to the inertia of the pump jack equipment and the counterweight, the pump is likely to pound several strokes prior to stopping completely after the POC has switched it off. This pounding results in shorter equipment life, longer downtime, and more maintenance requirements in all respects. Also for a brief time upon startup an electric motor uses from three to six times the electrical power required for normal continual running. Hence, the energy consumption in a start-stop operation greatly exceeds that used in constant operating conditions.

The most fundamental factor as to the quantity of production from a well is the rate at which fluid from the oil bearing zone of the geological formation initially flows through the perforations into the well to become available to be pumped to the surface. The rate of this flow of fluid into the casing/tubing annulus is a consequence of the degree of natural formation pressure available at the depth of the casing perforations. If the casing/tubing annulus into which the fluid flows is empty at the level of the perforations, the flow rate will take full advantage of the natural formation pressure and such flow will then be at the maximum rate possible, at least for a time. If, however, the casing is not empty at the perforation depth and has filled to some height above the perforations, the natural formation pressure and the consequent flow rate will be opposed by the backpressure or head pressure created by the height of the fluid already in the casing/tubing annulus. Hence, the rate of flow is directly influenced by the amount of backpressure exerted on the formation by the head of the column of produced fluids in the casing at any given time. The more head pressure against the formation flow, the slower that flow will be. Consequently, the most productive flow from the formation into the well occurs if the column level is constantly held at the very minimum height required for continuous pumping. The typical on/off cyclic pumping method described above fails in this respect. During a large percentage of the shut down times, when the well is refilling itself, and during the initial period of pumping after the timer has restarted the pump jack, the fluid level in the well is higher than necessary, and the formation flow is thereby unnecessarily retarded by the excessive back pressure.

The flow of fluid through the geological formation surrounding the well is also disadvantaged by the on/off cyclic pumping method. While the flow of fluid in the formation is a complex and multifaceted subject, it is generally accepted that maintaining constant movement without stoppages will enhance the flow rate of producible fluid delivered to the well.

Workers in the art have long been aware of the benefits of matching pumping extraction rates to formation fluid inflow rates. Techniques have been devised for detecting a variety of information concerning changes in flow rates and other operating conditions of the well in addition to the shock waves produced by the Pumped Off condition. Using such instrumentation, pumps have been run with variable speed drives or with on/off duty cycle timing in an effort to match formation inflow to pump output flow rates. Such systems have not, however, been directly responsive to production conditions or flow rate variations, and consequently have not been as efficient as theorized.

An advanced system of this nature is sold as a "well manager" under the "SAM" trademark, being manufactured by Lufkin Automation in Lufkin, Tex. This system carries out a number of functions in order to improve the pumping operation of sucker rod based marginally producing wells. It comprises a pump controller which monitors the operation of various mechanical components in addition to the condition and performance of the sucker rod string and downhole plunger pump. The "SAM" system senses the Pumped Off event by a strain gage and signals the motor to shut off. This again cannot be done immediately due to inertia in the system, so that a number of undesired shock impacts will follow each shut off command. The system then shuts down for a pre-selected length of time, varying with the conditions, to allow replenishment from the production zone.

This so-called "well manager" unit utilizes downhole detectors positioned near the down hole production zone level and line connected along the tubular system to the control system at the wellhead. These detectors provide real time and direct electrical inputs to the system as to the fluid levels in the pumping zone. To do this, the system must utilize expensive, sensitive and delicate pressure sensing gages and connect them by electric wire strung the entire length of the tubing string up the well to the wellhead. The system is difficult to install and maintain in satisfactory operating condition because of the non-robust components and the long electrical connection through the wellbore that is needed. It is adequate for real time monitoring of conditions in the production zone, but is subject to shock waves generated by the Pumped Off conditions. It is also very expensive and consequently is not widely utilized in well production installations.

There is therefore a need for a mechanical system which can monitor actual fluid level variations in the pumping zone and transmit operating data reliably from downhole locations to surface pump controls for maximizing production under varying operating conditions.

SUMMARY OF THE INVENTION

A petroleum well production maximizing tool in accordance with the invention utilizes mechanical energy generated by the pump mechanism to provide useful pressure wave indications or sonic impulses signaling in real time the presence or absence of fluid at one or two specific downhole levels relative to the pumping system. The impulses are of distinguishable characteristics and generated periodically during sucker rod cycling. These impulses have such time-based variations and energy that they not only propagate readily up the fluid column to the wellhead, but are readily discernible there. Instrumentation at the wellhead can therefore process the received signal information, along with inputs from other sources, and use these data to control pumping variables. The system employs reliable and sensitive components having long life characteristics, so that production management for a petroleum well can be maximized, for substantial time periods, while taking into account the numerous variables that can exist in well production.

The directly transmitted, real time fluid level readings can be used not only to maximize production, but also to identify changing conditions, and monitor well operation. Since this detection and signaling system is operated passively and remotely using the pumping action itself, it requires no other source of energy to transmit signals to the wellhead. The controller at the wellhead can therefore modulate the variable speed drive and thus the pumping rate, or it can command entry into the Pump Off mode in sufficient time to avoid shock impacts in the system.

In addition to direct readings of fluid levels derived at the production site, the system can also incorporate other features, such as flow meters for monitoring the production rate, short and long term, and a phase timing system synchronized to the pumping system, for distinguishing the downhole locations and conditions based upon the signals transmitted from the downhole site.

In one example of a system and method in accordance with the invention, two downhole sensors and generators are mounted in the tubing system at one or more elevations proximate the production zone in a manner to cooperate with the reciprocating sucker rod string. Trigger elements form physical parts of the moving sucker rod string and signal generators activated by the triggers are reciprocable along the static tubing. Each signaling device is activated by an associated trigger as it reciprocates with the cycling sucker rod string. The reciprocating triggers reliably engage pistons slidable in the tubing, forcing them against a compression spring mechanism, which drives the piston forcibly through a short travel. The spring actuated piston action impacts against a receiving surface to generate pressure waves in one example and sonic signals in another, transmitting a signal along the fluid column in the tubing to the wellhead that can be interpreted there to indicate the presence or absence of production fluid at the one or two sensing elevations.

The mechanisms utilized for both pressure and sonic transmissions meet modern oil field operational demands, in terms of reliability and operating life. In general, each signal generator, of both pressure wave and sonic types, includes a cylindrical piston with an elastomeric inner sleeve that is sized to yieldably grip the surface of a cylindrical trigger mounted on and moving with the sucker rod. The piston is forced down to a limit position as it compresses a spring, but the trigger ultimately forces through the sleeve, and the spring then energetically drives the piston up to initiate a pressure wave or sonic signal.

At the wellhead, it is convenient to incorporate substantial useful instrumentation for pumping control, and the wellhead equipment thus may include not only a signal receiver for detecting and processing pressure or sonic variations, but also circuits or software for defining time-based windows to synchronize the sucker rod cycles with actuation of the downhole detectors. The system can also incorporate a Pump Off Controller and can operate satisfactorily for many purposes using only one downhole detector.

Control of the pumping system in accordance with the information derived from the detectors enables a greater degree of precision than has heretofore been achievable. For example, after initial flow from the production zone into the well and subsequent starting of the downhole pump, a period of time is required for the pump to approximate the production rate and to deliver excess fluid that may have accumulated. Using the signals from the downhole sensors, the system can calculate the duration needed for fluid level changes, and adjust the flow rate to a first approximation. Thereafter, variations in the flow from the formation may take the level of accumulated fluid to the elevation of a sensor, so that more precise recalculations can be made and the flow readjusted. By thus maintaining the fluid level in a controlled range the back pressure from the fluid volume within the tubing/casing annulus is kept to a minimum, maximizing the formation flow and reducing power usage. In addition, the Pumped Off condition can be minimized or avoided, the formation flow can be continuous, and the pump jack can be allowed to run virtually constantly with a minimum of energy consumed in start-up cycles.

In a pressure wave signal generator system in accordance with the invention, the trigger device forming a part of the sucker rod and movable with it engages an compliant interior actuator sleeve on an axially slidable signal piston to force it down against an associated compression spring. Further downward movement of the sucker rod releases the piston actuator from the trigger and initiates the pressure wave action as the piston is driven upward by the compression spring. The piston abruptly moves to engage the facing end of a fixed connector and close an internal signal chamber that is open to the tubing/casing annulus through ports geometrically placed in the casing wall. If fluid is not then present at this level in the tubing/casing annulus, the piston movement abruptly moves a volume of fluid upwardly within the tubing to send a pressure wave up the column of fluid in the tubing, to the wellhead.

The piston design incorporates apertures in a fixed barrel surrounding the piston and also external chambers defined between the piston exterior and the surrounding barrel, which are so designed as to blunt and buffer the shock of the piston as it closes if the fluid level in the tubing/casing annulus is above the sensor. If so no pressure wave signal is sent. To this end, the pressure wave generating mechanism is designed so that the chamber, between the barrel and the piston is divided into a stroke section and a stall section, variably defined by opposite sides of a fixed split ring attached to the barrel. Ingress to and egress from the chamber are determined by pores in the barrel wall. With fluid in the tubing/casing annulus, spring energy is taken up in transferring fluid out of the ports in the barrel wall from the stroke chamber, thus attenuating the pressure wave received at the wellhead so much that the signal cannot be detected.

Sonic signaling devices in accordance with the invention also employ a cylindrical signal piston having a compliant actuator sleeve engaged by a trigger on the sucker rod string, and a compression spring that is cocked by movement of the sucker rod trigger, to drive the piston upward when released. When thus fired, the piston strikes like a hammer against a fixed anvil concentric with the tubing which is in contact with the fluid column leading to the wellhead. The anvil includes an acoustic lens which creates sonic impulses at selected frequencies to identify thereby the different detectors and also to identify whether or not there is petroleum at that elevation. The sources of these impulses can also be interpreted using the phase relation of the received signals to the phase of the sucker rod cycle.

BRIEF DESCRIPTION OF THE DRAWINGS

A better understanding of the invention may be had by reference to the following description, taken in conjunction with the accompanying drawings, in which:

FIG. 2 comprising interconnected

FIG. 4, comprising interconnected

FIG. 5, comprising interconnected

FIG. 8, comprising interconnected FIG. 9, comprising interconnected

DETAILED DESCRIPTION OF THE INVENTION

Figure 1:
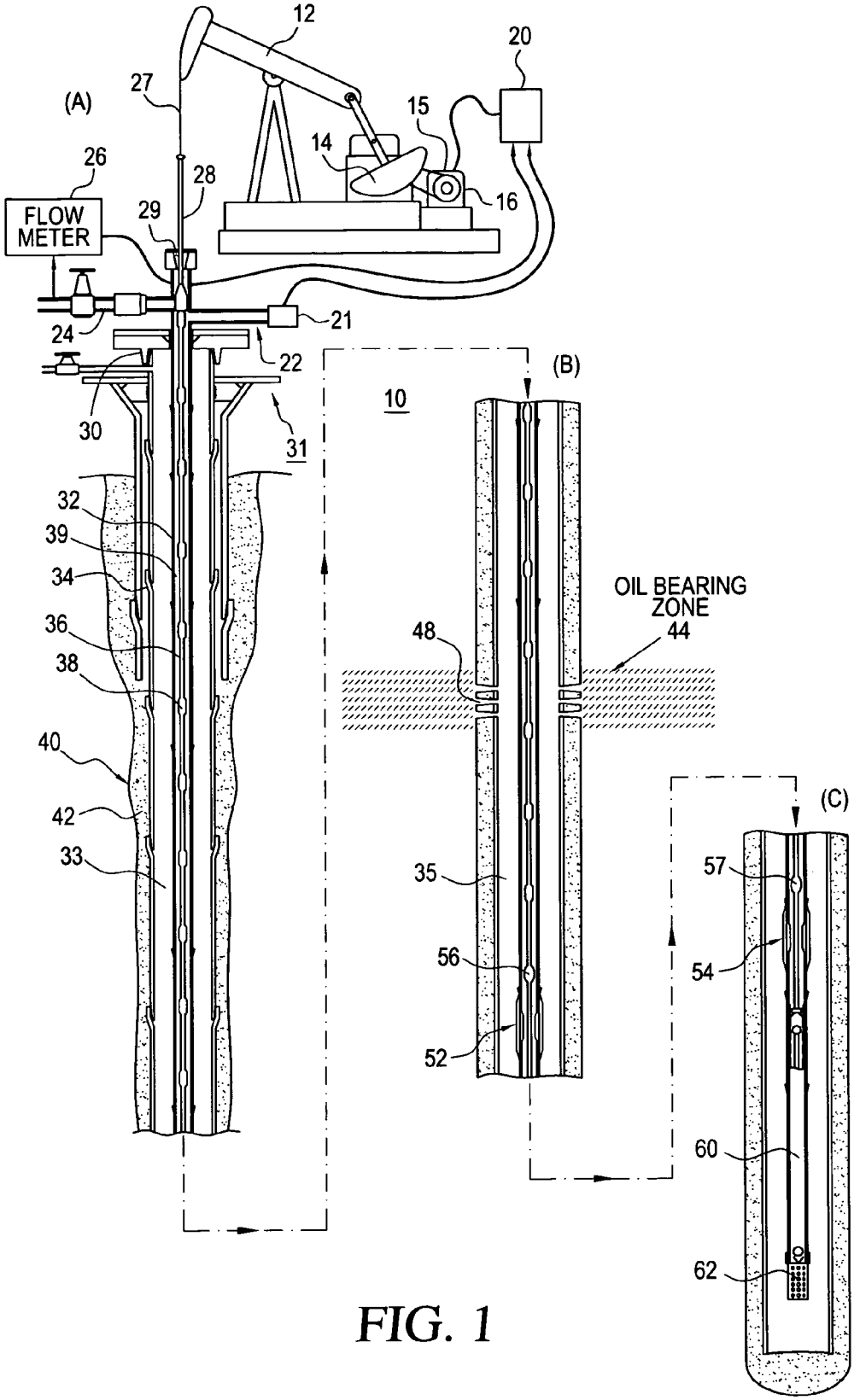
FIG. 1, comprising interconnected Figs A, B and C, is an idealized side-sectional view, truncated and reduced in scale, of a typical petroleum well configuration employing a reciprocating type pump and sensors for downhole petroleum level detection.

A petroleum well installation incorporating a production maximizer system in accordance with the invention is shown (FIG. 1) as used at a largely conventional well pumping installation 10 in which a pump jack 12 of the horsehead type reciprocates on a pivot, the rotational forces required for pumping being compensated by a rotating counterweight 14 at the end of the pump jack 12. The counterweight 14 and pump jack 12 are cycled by a drive motor 16, here of the variable speed type, which delivers rotary power through a gearbox 15. Also at the wellhead, a controller system 20 is provided that receives inputs from a signal receiver 21 coupled to the end of a shunt flow line 22 at a wellhead level below the output flow line 24, which line transfers the oil produced to storage tanks (not shown) during pumping operations. Reference should also be made to the block diagram of FIG. 6 for further understanding of operational relationships.

The signal receiver 21 detects pressure or sonic signals transmitted in accordance with a predetermined signaling protocol from downhole locations, as described hereafter. The output flow line 24 branches out from the downhole production tubing at a level above the shunt line 22, and includes a flow meter 26 which also provides an input signal to the controller 20.

The remainder of the system at the wellhead 31 is largely conventional, and will therefore only be summarized. The horsehead end of the pump jack 12 is coupled via a horsehead bridle 27 to the upper end of a polish rod 28 that extends through a rod seal 29 into the interior of the downhole tubing system which begins at the tubing head 30.

The tubing head 30 at the top of the wellhead 31 structure encompasses the string of tubing 32 which extends down through the wellbore 40 to adjacent its deepest elevation. The tubing 32 contains the fluid column 35 of produced fluids that is being lifted from the production zone. The encompassing casing 34 is spaced from the tubing 32 to define a tubing/casing annulus 33 and is itself typically encased in a cement packing 42 within the wellbore 40. The tubing 32 and casing 34 are assembled from strings of sectional pipe with interspersed couplings 38 in the conventional form. Along its center axis, the well system includes the longitudinal string of sucker rods 36 which are interconnected principally by conventional couplings.

The wellbore installation is shown in FIG. 1 in idealized form, as a typical moderate depth production well, but it will be recognized that the longitudinal dimensions are reduced and not to scale. As shown by the legends, the total well depth is assumed to be about 6000 ft. in this example, and the formation production zone 44 is here illustrated (FIG. 1) as about 5900 ft. The well casing 34 includes perforations 48 allowing ingress of oil bearing formation fluid 35 at the level of the formation production zone 44 into the annulus 33 between the tubing 32 and casing 34. Production flow rises to a level in the tubing/casing annulus 33 above the well terminus that is determined by the formation pressure and the differential between the existing inflow and pumping rates. A production fluid 35 rising to above the level of the oil bearing zone is depicted in the example of FIG. 1(B). Upward flow to the wellhead 31 is through the annulus 39 between the tubing 32 and the sucker rod 36.

Conventional couplers 38 are incorporated in the tubing string down to the upper sensor 52, but below that zone two tubing 32 sections are coupled together by sensor and signaling devices 52, 54 at specific levels above the pump (which may be set below or above the production zone 44). Alternatively, only one sensor/signaler may be used placed at a selected elevation above the pump, as described below. The devices 52, 54 cooperate with piston triggers 56, 57 on the sucker rod string 36, which triggers are precisely placed to control timing of the signals generated. Also they are positioned in relation to the sucker rod cycle so that when the lower sensor 54 is sending a pressure wave up the fluid path through the upper sensor 52 is open. The upper sensor and signaling device 52 and the lower sensor and signaling device 54 also act as mechanical couplers which support the mass of the lower portion of the tubing 32, as well as the plunger pump 60 which is reciprocated by the sucker rod 36 string. Dependent on known production history of the well, the upper sensor 52 is generally spaced about 30-50 ft. above the lower sensor 54, which itself is generally about 18 feet above the plunger pump intake 62 at its lower end.

Signal-Sensor Device Components for Pressure Wave Example

The following describes the elements of the downhole signal/sensor combination listed generally in order from the top and outermost components of the tool to the bottom and innermost. The first practical example is of a system, shown in FIGS. 2-5, (to which reference is now made) in which pressure waves are generated of sufficient energy to be transmitted to and detected at the wellhead installation. The reference number noted for each component corresponds to the attached drawings. Different wells are equipped with different sizes of tubing, casing, and sucker rods and of course extend to different depths. They may also be directionally drilled, but such alternatives are not shown herein. The drawing provided here as an example depicts a 1 inch sucker rod string inside a 2⅞ inch tubing string inside a 5½ inch casing string, a fairly typical combination. Reference should now be made to the larger sectional interconnected views of FIGS. 2 to 5, concentrating on the device relating to generation of a pressure wave. These views show the physical construction from top to bottom and the operative relationships which control the fluid dynamics.

70 Top Connector—The Top Connector 70 is equipped with a standard female tubing threaded connection 71 facing upward whereby the signal sensing tool is connected into the existing tubing string at the selected downhole level. The top connector 70 is a robust adapter that carries and transfers the tensile load and mechanical stresses present in the lower end of the tubing string 32. The type of top connector used will be optional but is chosen to match to the existing tubing string 32 in the well. Below the upward facing standard female threaded connection 71 which joins to the length of tubing 32 above, the top connector 70 swages out to a larger diameter male threaded connection whereby more interior space is provided for the device components below. At the bottom of the top connector 70 an exterior circumferential relief or groove is cut such that a circumferential chamber is defined when the top connector 70 is made up (threaded) into a depending cylindrical carrier barrel 72 coaxial with and slightly greater in diameter than the tubing 32. This circumferential chamber, open to the downward side is referred to as the fluid cushion chamber 74 and serves to receive and decelerate a movable signal piston 78 slidable within the barrel 72 during operation. The interior wall of the top connector 70 defining the fluid cushion chamber 74 is perforated near its lower end by a series of circumferentially equally spaced holes 76 radially drilled through the chamber wall into the annulus 39 between the tubing and rod string. These holes serve to bleed the fluid cushion chamber 74 and are referred to as deceleration ports 76.

72 Barrel—The barrel 72 encloses and contains the tool components and also carries and transfers the tensile load from the top connector 70 to a bottom connector 110 (FIG. 2B) that couples to the next section of tubing 32 by a standard coupling 38. The barrel 72 is female threaded on each end to thread into the top and lower connectors 70, 110 respectively. The barrel 72 is apertured radially by three series of ports 84, 86, 90 (FIG. 2A) circumferentially placed about the barrel, each series being at a different level along the length of the barrel 72. The ports function, together with the chamber defined between the piston and the barrel, to provide the system with the capability of distinguishing between the presence and absence of fluid in the casing/tubing annulus 33. The uppermost series of ports are referred to as the stroke ports 84 and entail a number of equally circumferentially spaced holes drilled radially through the barrel 72 just above a split ring 73 fixed to the interior of the barrel 72. The next lower series of ports are referred to as the stall ports 86 and consist of a number of circumferentially equally spaced holes drilled through the barrel 72 just below the location of the interior split ring 73 secured to the barrel 72. The lowermost circumferential series are the stall drain ports 90 which are drilled radially some distance below the stall ports 86. Two further ports, both here called threaded lube fill ports 96, are located at 180 degrees to each other in the lower body of the barrel 72. The internal surface of the barrel 72 is honed to a particularly smooth finish to accommodate the sliding action of the signal piston 78 which reciprocates over a preselected span within it.

Figure 2A:
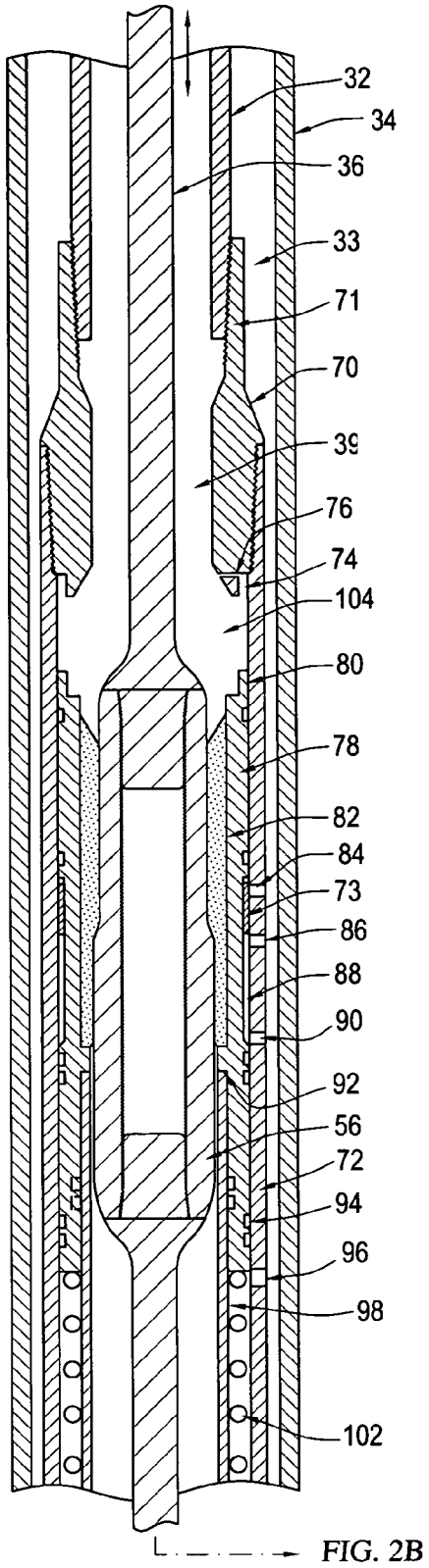
FIGS. 2A and 2B, is a fragmentary view of a fluid detector and pressure wave signal generating mechanism, for signaling from a downhole petroleum level in the arrangement of FIG. 1, showing a signal piston in cocked position relative to a trigger.
Figure 2B:
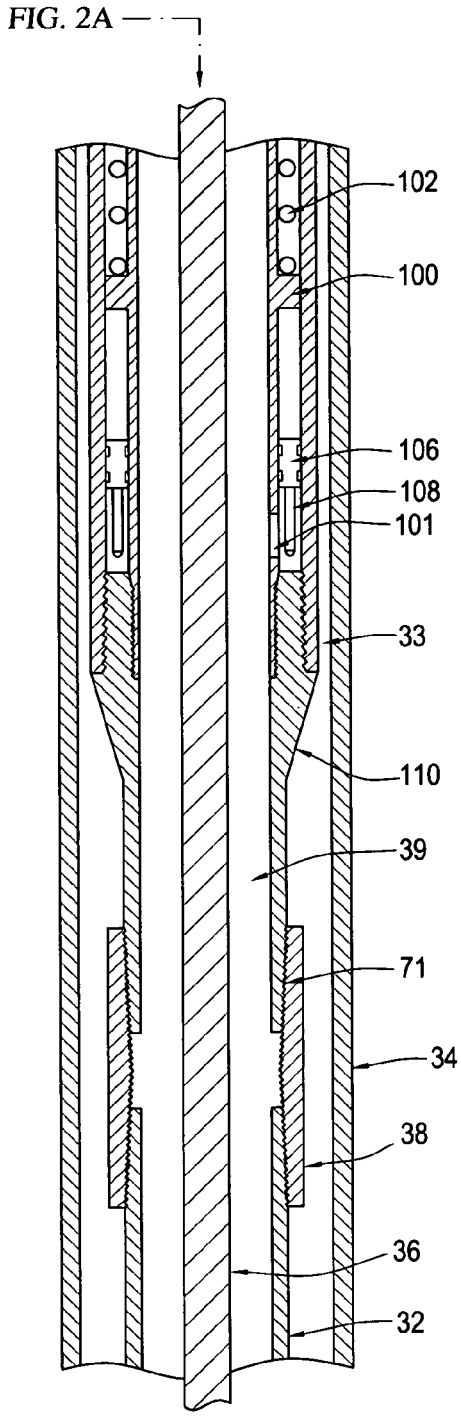

73 Split Ring—The split ring is a two piece ring attached to the internal surface of the barrel 72 by screws that pass through the barrel 72 and thread into the two pieces of the split ring 73. The split ring 73 serves to movably separate upper and lower sections of a cavity or relief cut circumferentially into the external surface of the closely adjacent signal piston 78, into two chambers of variable size, depending on the axial position of the signal piston. The open stall chamber 88 is shown in FIG. 2A and the stroke chamber 89 is seen at maximum amplitude in FIG. 3A.

78 Signal Piston—The signal piston 79 is a hollow cylindrical element positioned inside the barrel 72 and capable of sliding bidirectionally axially, within limits, in the barrel 72. The signal piston 78 is supported externally along its entire length by the barrel 72 and internally along its lower portion by a piston slide tube 98. Dynamic external lip seals 94 mounted on the signal piston 78 contact the internal surface of the barrel 72 while internal lip seals (not numbered) contact the external surface of the piston slide tube 98 to permit axial movement with minimal leakage. The external lip seals 94 and internal lip seals are so small they cannot readily be depicted in these views within the grooves that are shown. The upper end of the piston 78 is shaped with an internal relief or groove cut so as to create an external ring referred to as the piston cushion ring 80. The piston cushion ring 80 is designed to, with some clearance, fit matingly into the lower end of the top connector 70 proximate the fluid cushion chamber 74 when the signal piston 78 is at the end of its upward stroke. Internal to the signal piston 78 slightly below the mid-region is a second internally facing horizontal ledge referred to as a stop shoulder 92. At the limit of the signal piston's 78 downward movement the stop shoulder 92 encounters and is restricted by the upward facing end of the piston slide tube 98.

Toward the lengthwise center and on the external surface of the signal piston 78 a recessed area of a predetermined length is formed into the outside surface of the piston body. With the signal piston 78 installed inside the barrel this recessed area is enclosed externally by the barrel 72 wall to create a circumferential chamber or cavity that is bounded internally by the undercut wall of the signal piston 78. This circumferential chamber encloses the split ring 73 and the internal diameter of the split ring 73 matches, with some clearance, the internal surface of the chamber. When the signal piston 78 is driven to its maximum downward position the position of the circumferential chamber relative to the split ring 73 creates a circumferential cavity below the split ring 73, here referred to as the stall chamber 88. At that maximum downward position the stall chamber 88 is open to the stall ports 86 at its top level and the stall drain ports 90 at its lowest level. When the signal piston 78 is released axially, it is driven upward by a compression spring 102 to its maximum upward position. The position of the circumferential chamber relative to the split ring 73 then creates a cavity above the split ring 73, here referred to as the stroke chamber 89. At that position the lowest level of the stroke chamber 89 is in communication with the stroke ports 84 in the barrel 72 wall.

Figure 3A:
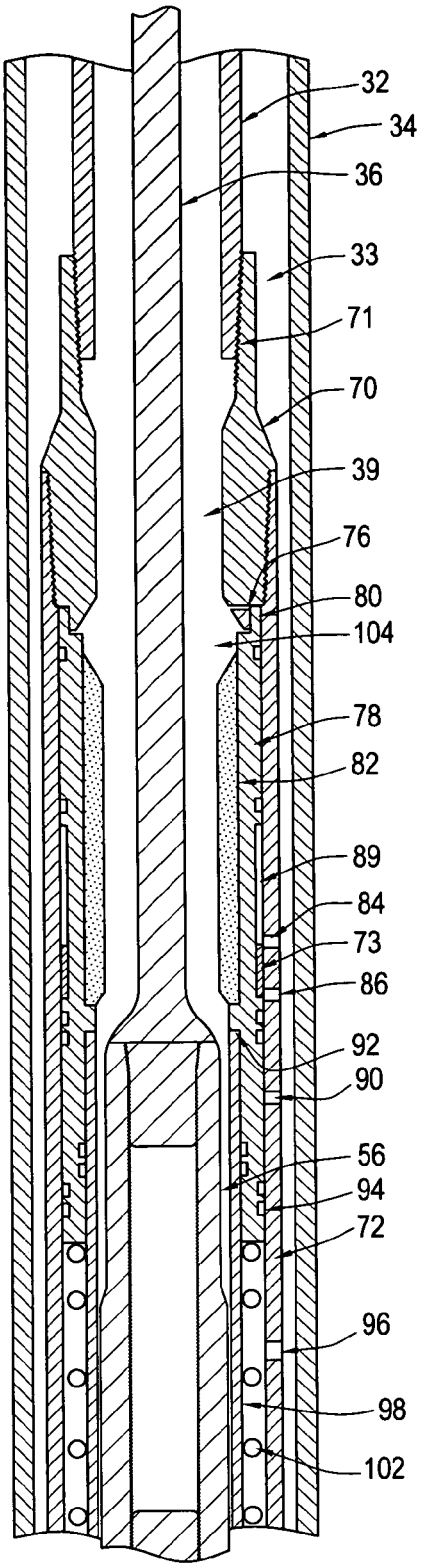
FIGS. 3A and 3B, are fragmentary views of a level detector and pressure wave signal generating mechanism in the system of FIG. 1, showing the signal piston in the fired position relative to the trigger.
Figure 3B:
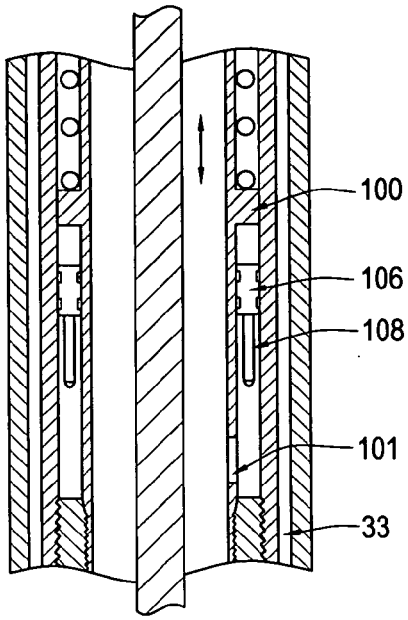
Figure 3C:
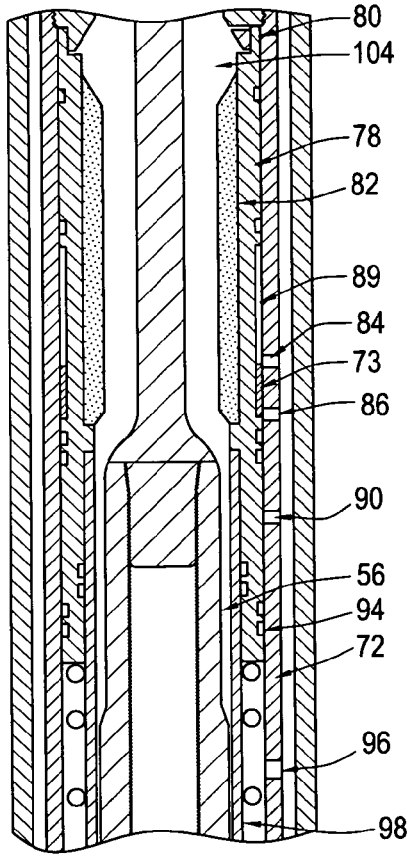
FIG. 3, comprising interconnected
Figure 4A:
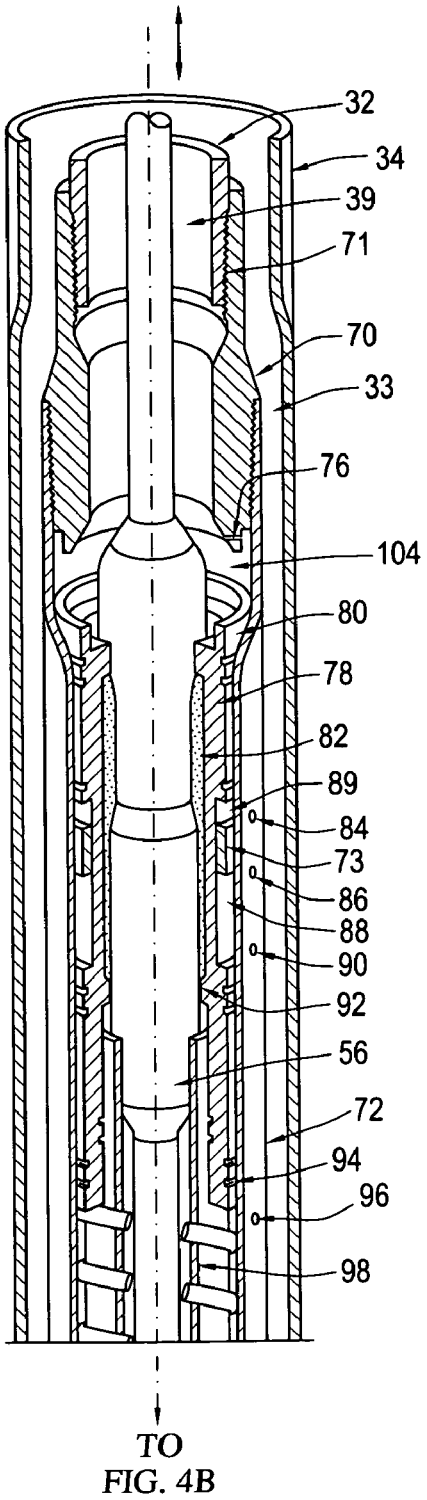
FIGS. 4A and 4B, is a broken away perspective view of the pressure wave generating version of FIGS. 2 and 3, showing features of the system in greater detail, with the signal piston in cocked position.
Figure 4B:
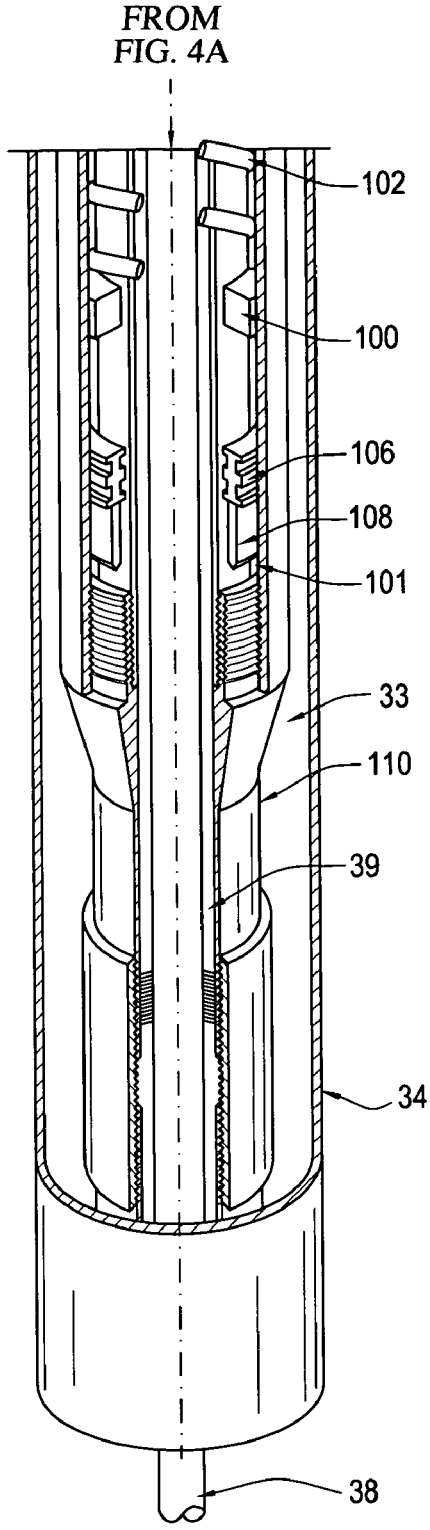
Figure 5A:
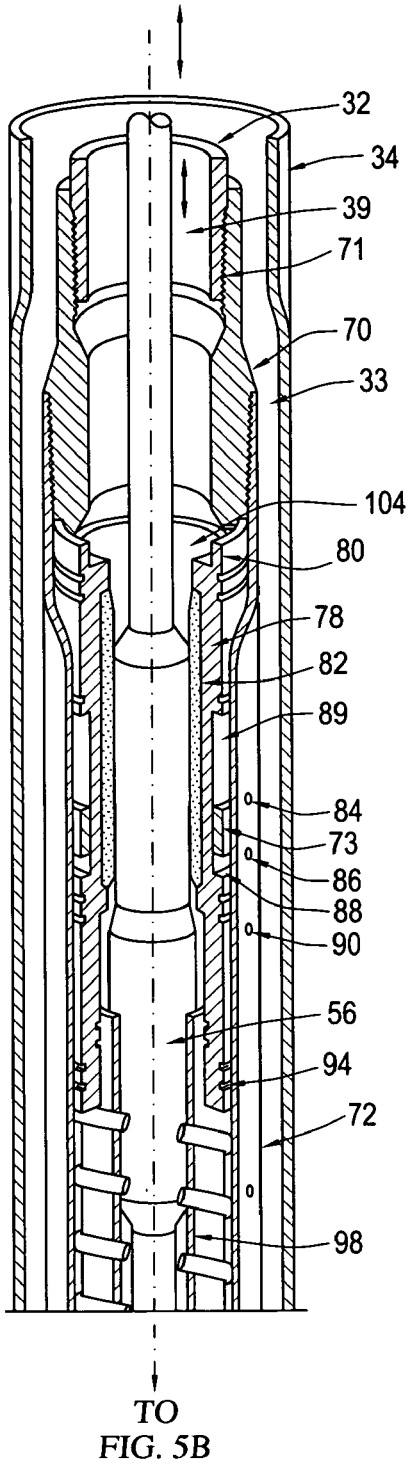
FIGS. 5A and 5B, is a broken away perspective view of the arrangement of FIGS. 2-4, also showing features of the system in greater detail, but with the signal piston in fired position.
Figure 5B:
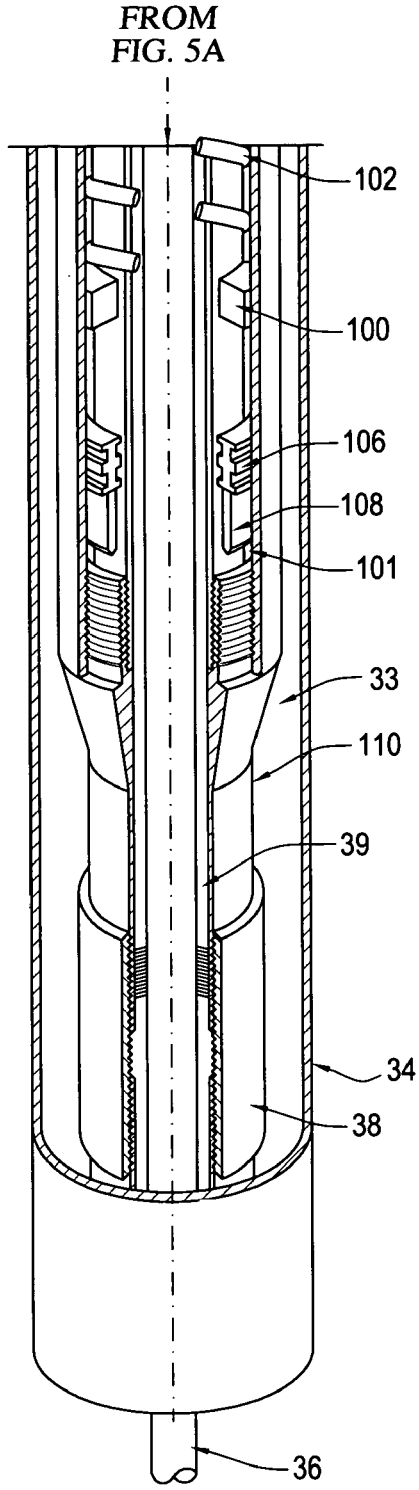

82 Piston Actuator—On the internal surface of the signal piston 78 and integrally attached to the signal piston 78 is a flexible sleeve or actuator of frictional, resilient material that protrudes inwardly from the piston adjacent its vertical centerline. This sleeve is referred to as the piston actuator 82 and it operates in conjunction with the rod string 36 mounted trigger 56 which is received within it. The internal diameter of the piston actuator 82 at rest is smaller than the external diameter of the trigger 56 over a lower section (approximately half its length) of a dimension adequate for a chosen span of movement of the signal piston 78. The upper part (approximately half) of the piston actuator 82 has a larger inner diameter and provides less purchase on the trigger 56 and therefore less restraint. When the trigger 56, moving down axially, encounters the lower half of the piston actuator 82, a dimensional interference ensues which, as the trigger 56 engages, creates a restraining friction between the two parts. This restraining friction is enough to drive the signal piston 78 axially downward against the compression spring 102, the lower end of which engages the spring supports or support lugs 100. The piston 78 compresses the spring 102 until the piston encounters the limit of its movement, defined by engagement of the stop shoulder 92 against the upper end of the interior piston slide tube 98. At this point also the trigger 56 diameter has changed so there is less surface interference with the piston actuator 82, the friction is overcome and the trigger 56 passes on through the piston actuator 82 thereby releasing it as seen in FIG. 3B and in FIG. 5B. The sucker rod 36 continues its downward stroke through a much longer span, typically 12 to 22' in length. This provides an opening for any pressure waves from a lower pressure wave signal generator if one is used. This opening exists through the majority of the sucker rod cycle, and system operators therefore need only assure that there is proper timing of pressure waves from different detectors, if more than one is used in a system.

102 Compression Spring—The signal piston 78 is driven in the upward direction, when released, by the compression spring 102 which is sleeved over the piston slide tube 98. The compression spring 102 is supported below by the spring support lugs 100 which are integral with the piston slide tube 98. The compression spring 102 engages the signal piston 78 base at its upper end, and has a spring force or mechanical compliance sufficient to enable it when released to propel the signal piston 78 forcefully upward to its limit position, in engagement against the bottom ring wall of the top connector 70. The signal piston 78 is accelerated sufficiently to transmit a discernible pressure wave signal up the tubing string to the wellhead, provided that fluid is not present in the tubing/casing annulus at that elevation at that time. If the production level is higher than the detector, however, the chambers and ports provided diminish the pressure wave energy sufficiently to damp the signal.

98 Piston Slide Tube—The piston slide tube 98 is externally threaded on its lower end where it makes up into the internal threads of the bottom connector 110. A series of entry windows 101 are positioned circumferentially in the piston slide tube 98 just above the bottom connector 110 to allow full communication of fluid from the tubing/rod string annulus 39 into the lower portion of the tool. Integral to the piston slide tube 98 are the spring supports 100 which consist of four circumferentially equally spaced lugs that extend radially out from the outside diameter of the tube 98 to a diameter just short of the inside diameter of the barrel 72. The external surfaces of the piston slide tube 98 are of a smooth finish to accommodate the sliding lip seals 94 of the signal piston 78 and the O-ring seals of an equalizer piston 106.

106 Equalizer Piston—The equalizer piston 106 (FIGS. 2B and 3B) is a cylindrical piston that slides axially within the annulus created by the internal surface of the barrel 72 and the external surface of the piston slide tube 98. The equalizer piston 106 is equipped with a positioning skirt 108 or spacer (seen also in FIGS. 4B and 5B) on its downward end which serves to limit travel of the seal area of the piston downward beyond the top edge of windows 101 in the piston slide tube 98. The skirt 108 is broadly periodically slotted lengthwise to allow an even ingress of fluid against the piston. The equalizer piston 106 typically includes seal rings (not shown in detail) sealing against the adjacent walls both internally and externally, and is free to move vertically in response to pressure differentials between the fluids on each side. This equalizes the pressures above and below, stabilizing the lower end of the detector system.

110 Bottom Connector—The bottom connector 110 is equipped at its upward end with outward facing male threads to accept the barrel 72 and inward facing female threads to accept the piston slide tube 98. On the downward end of the bottom connector 110 are standard male tubing threads whereby the tool is reconnected to the tubing string 32.

Signal-Sensor Device Operation with Pressure Wave Transmission

As discussed previously, the production maximizer system functions by monitoring fluid levels at one or more elevations in the well and responsively directing the operation of the pump in accordance with that knowledge. Two sensor/signal devices 52, 54 can be used to monitor fluid levels, but one device at a chosen level in conjunction with a POC (Pump Off Controller) can provide adequate information for many purposes, albeit without the advantage of completely avoiding the potentially damaging pumped off condition. This approach is particularly useful where production rate variations are relatively long term or minor in character. All the sensor/signal devices detect the presence or absence of fluid in the well at, in the case of the sensor/signal device, the device position, and, in the case of the POC, the pump intake 62. By this information the fluid level can be constantly maintained in a position between the two devices, or between one device and the pump intake 62.

When there is no production fluid in the tubing/casing annulus 33 at the level of a detector, the detector produces a specific and identifiable signal in the form of a shock-generated pressure wave that travels through the fluid column along the tubing/rod string annulus 39 to the signal receiver 21 at the wellhead. When there is fluid present in the tubing/casing annulus 33, no such detectable signal is produced, because of shock-reducing fluid transfers between the annulus 33 and the stroke chamber 89 and stall chamber 85 defined by the exterior of the signal piston 78 and the adjacent surface of the barrel 72. The absence of a pressure wave is a reliably detectable event, determined by the binary state of zero signal in the appropriate predetermined time window.

Figure 6:
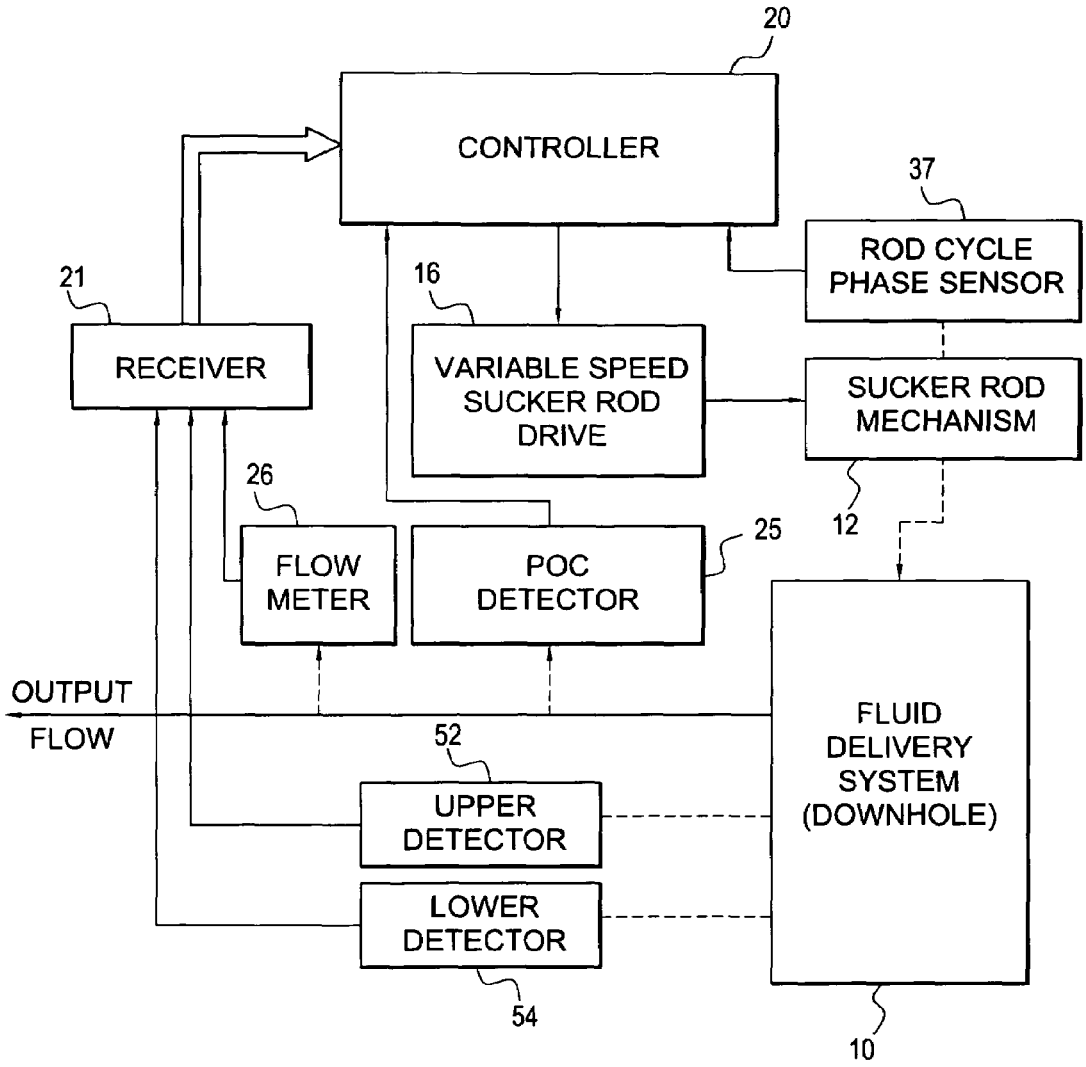
FIG. 6 is a block diagram of wellhead circuits used in receiving and processing sensing and control signals employed in systems in accordance with the invention.

As the block diagram of FIG. 6 evidences, the system includes subsystems and components to monitor the phase of the sucker rod as it is cycled, in order to define detection time windows that encompass the phase angles at which signals might be generated and transmitted. The system also receives, at the controller 20, via the receiver 21, inputs from the flow meter 26, the upper detector 52 and the lower detector 54. In the alternative version in which only one detector 52 is used, a sensor or detector 25 for the pump off condition is employed instead of a lower zone detector. The phase of the sucker rod system is monitored by a phase sensor 37, so that by knowing when a pressure wave signal is supposed to be received, the absence of a signal at that time window has a definite binary value. If no signal is received in the window of time allotted for a sensor, this means in the pressure wave version that fluid has been sensed at that level. The sucker rod cycles at a conventional rate (6-12 strokes/min, and the velocity of propagation of pressure waves along the tubing string is affected only slightly by the variation in configuration of the sucker rod and coupling system, approximating the velocity of sonic waves, which travel in petroleum at approximately 5× the speed of sound in air. The time window for signal reception at the wellhead is thus a reliable way to distinguish between conditions of liquid presence and absence, as further detailed below.

Because the reciprocating trigger 56 is attached to the sucker rod string 36, which is reciprocated by the pump jack 12 in a constant repetitive manner, the trigger(s) 56, 57 will always encounter the associated sensor signal device 52 or 54 at the predetermined stroke positions of the pump jack 12. For this reason the necessary distinction between a signal coming from the top sensor and one coming from the lower signal can be determined by the location of the horse head in the pump stroke cycles. For example, an installation configuration may be arranged whereby the upper trigger 56 encounters the upper sensor 52 within a position range of between 100 and 110 degrees on the downstroke of the pump jack 12, and the lower trigger 57 encounters the lower sensor 54 within a position range of between 230 and 240 degrees. The capacity to consistently anticipate the position of the pump jack 12 when either sensor device 52, 54 is triggered provides the means by which the system computer 20 can always distinguish whether it is receiving a binary "one" or binary "zero" signal. Thus, in the example given, if the signal receiver 21 and computer 20 receive a signal when the pump jack 12 is passing between 100 and 110 degrees on its downstroke and then receives no signal when it passes between 230 and 240 degrees, it will know that there is no fluid at the top sensor 52 level and that there is fluid on the bottom sensor 54 level.

Proper fluidic action for damping the signal piston 78 stroke and diminishing a pressure wave when the signal piston 78 is driven up by the spring 102 is achieved by the ports 84, 86 and 90 which allow fluid communication between the casing/tubing annulus 83 and the stroke chamber 89 and stall chamber 88. These chambers are of variable volume on opposite sides of the split ring 73 as the signal piston 78 moves. If liquid is present in the stroke chamber 89 it is evacuated through the stroke ports 84 as the signal piston 78 moves downward to close the gap with the split ring 73. The same downward movement fills stall chamber 88 through the stall ports 86 with liquid as the stall chamber 88 expands. The stall ports 86 and stroke ports 84 are sized such that if air or gas is present in the annulus 33 instead of liquid there is no impediment to movement of the signal piston 78. Whether or not encountering liquid from the annulus 33 the signal piston 78 is forced down against the compression spring 102 to the point where the stop shoulder 92 on its inside edge encounters the upper end of the fixed piston slide tube 98. At that point the signal piston 78 is cocked and it stops, so the friction grip of the piston actuator 82 on the moving trigger 56 is overcome as the trigger 56 passes through, losing contact with the piston actuator 82 as the sucker rod 38 continues the downward movement in its cycle. When it does so the signal piston 78 is released and propelled sharply upward by the compression spring 102 causing a vigorous liquid expulsion along the tubing if fluid is not present in the annulus 33 between the casing and tubing at that downhole level. This almost instant upward movement serves to displace fluid in the area of the signal chamber 104, communicating a pressure wave through the fluid in the tubing/rod string annulus 39 up to the signal receiver 21 at the surface. As referenced previously and below, however, if fluid is in the tubing/casing annulus 33 at that elevation, the ingress and egress of fluid through the various ports along the stroke chamber 89 and the stall chamber 88 oppose the spring action sufficiently to reduce the energy in the pressure wave to below a discernible level at the receiver 31. At the very end of the spring 102 powered upward stroke of the signal piston 78, the piston cushion ring 80 located at the very top of the piston 78 enters into the fluid cushion chamber 74 where, to some degree, it briefly traps a quantity of fluid. The entrapped fluid is discharged from the fluid cushion chamber 74 through the deceleration ports 76 back into the tubing/rod string annulus 39 as the piston decelerates and finally comes to rest against the top connector 70. By this arrangement and configuration the piston 78 is slowed to a near stop prior to hitting the top connector 70, thereby avoiding damage to both components.

The open areas within the barrel 72 surrounding the compression spring 102 and above the equalizer piston 106 are filled with a lubricant at the time of installation. Seals on the equalizer piston 106 isolate that lubricant from the formation fluid in the tubing/rod string annulus 39. The equalizer piston 106 moves freely up and down between the barrel 72 and the piston slide tube 98, so as to equalize the pressure in the lubricant filled interior area with the pressure in the tubing/rod string annulus 39 at all times including during the rapid upward stroke propelled by the spring 102 that generates the signal. By these means the lubricant is kept intact and the formation fluid is allowed to displace the exchange of volume caused by the piston 78 movement. Entry windows 101 in the piston slide tube 98 and windows in the positioning skirt 108 allow displacement fluid access to the equalizer piston 106 area.

If fluid is present in the tubing/casing annulus 33, the stall ports 86 allow restricted flow of fluid into the stall chamber 88, thereby requiring much more downward force to cock the signal piston 78. Consequently the friction between the trigger 56 and the piston actuator 82 is overcome much earlier in the downward stroke and the piston 86 only partially compresses against the compression spring 102. Further, when the piston 86 is released, the stall chamber 88 has been filled with fluid which must be evacuated through the stall ports 86. This also serves to slow the piston 86 dramatically, such that no discernible pressure signal will be generated.

This sequence of fluid transfers generates a pressure wave by rapidly ejecting over 8 $in^3$ of fluid (in this example) upward in the fluid column in the tubing 32 up to the wellhead. The energy of the impulse is little attenuated in moving up thousands of feet, because the sucker rod/tubing annulus 39 is substantially open and introduces little impedance until the receiver 21 is reached. If two downhole detectors are used, the controller 20 identifies the signal on the basis of the phase information from the phase sensor 37 seen only in the system diagram of FIG. 6. If only one downhole detector is used, it is placed at the upper position, and pump rates can be varied so as to try to keep the fluid close to that level, or the pump can be stopped for a time when a signal is provided from the POC detector 25 (FIG. 6 also).

Sonic Systems

Figure 7:
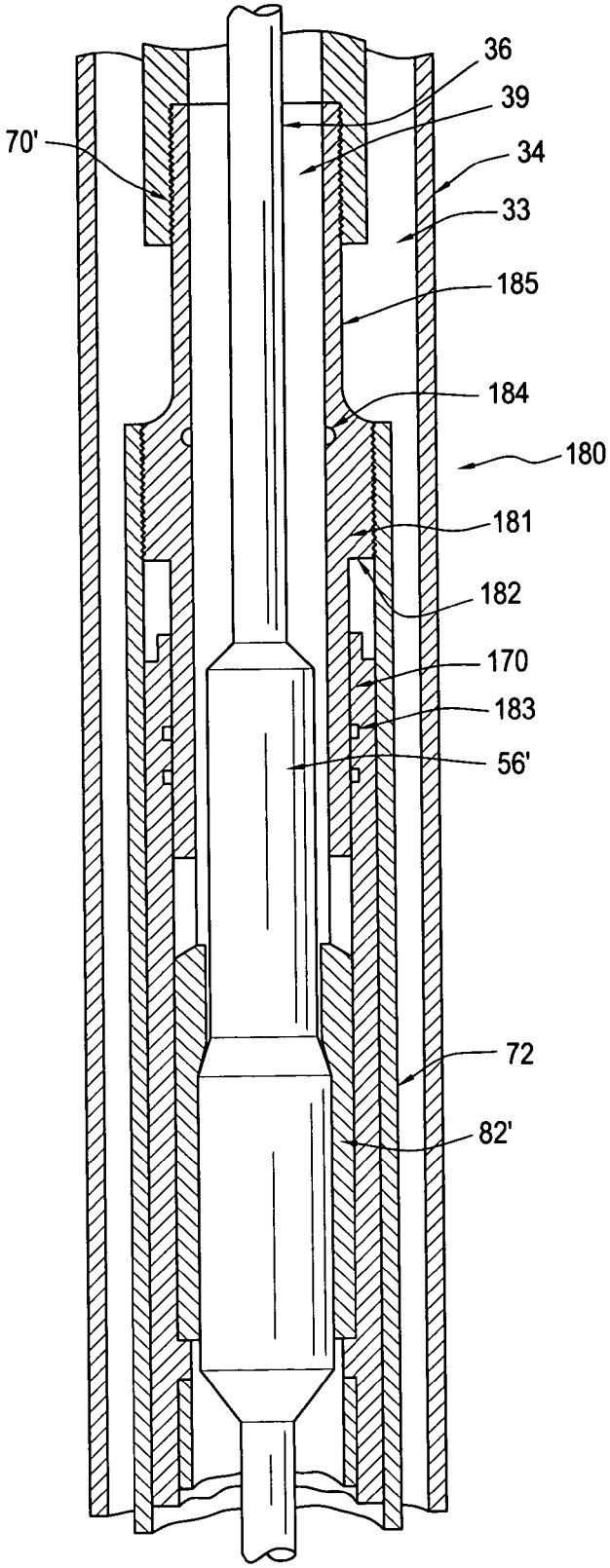
FIG. 7 is a side sectional partial view of a sonic downhole system for detecting the presence of fluid at a production level and generating a sonic signal responsive thereto showing a signal piston in cocked position.
Figure 8A:
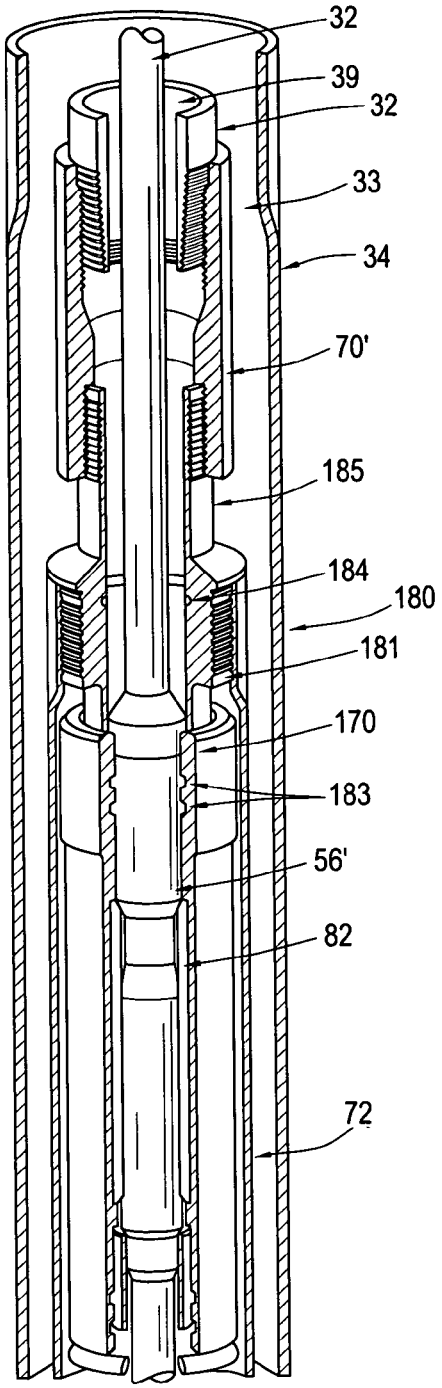
FIGS. 8A and 8B, is a breakaway perspective view depicting a fluid detection and sonic signal generation system in accordance with the invention, showing the a signal piston in the cocked position relative to a sonic anvil.
Figure 8B:
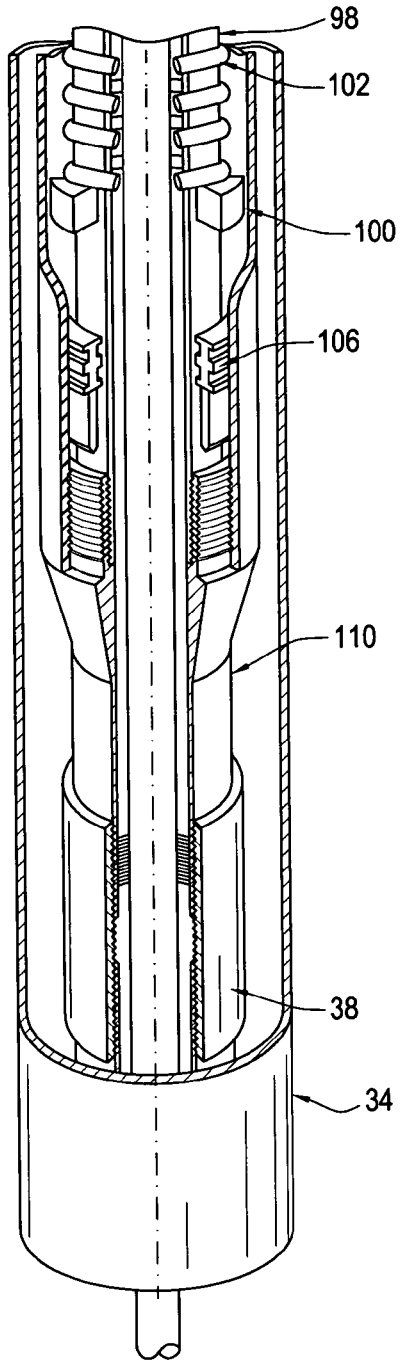
Figure 9A:
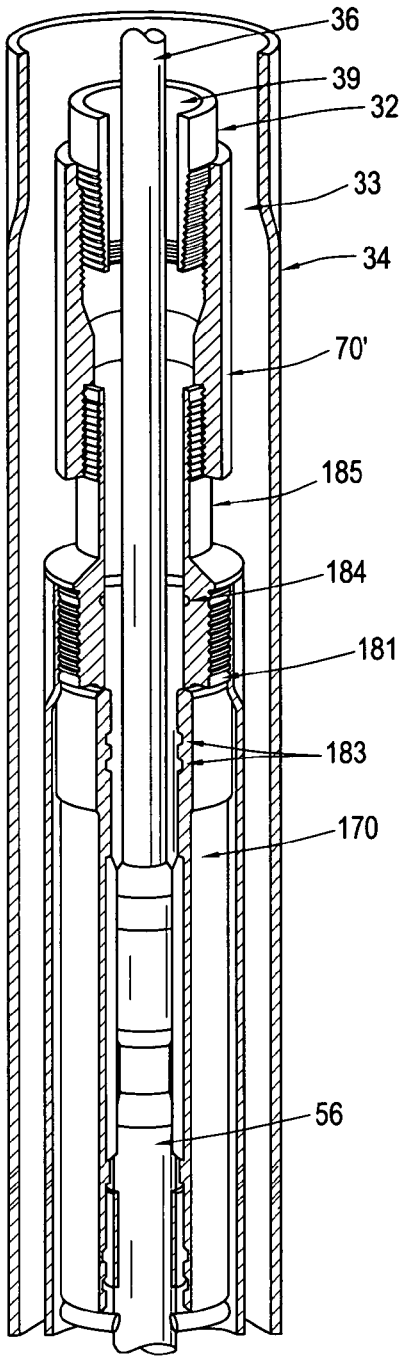
FIGS. 9A and 9B, is a perspective view, partially broken away, of the fluid detection and signal generator device of FIGS. 7 and 8 showing the signal piston in the fired position.
Figure 9B:
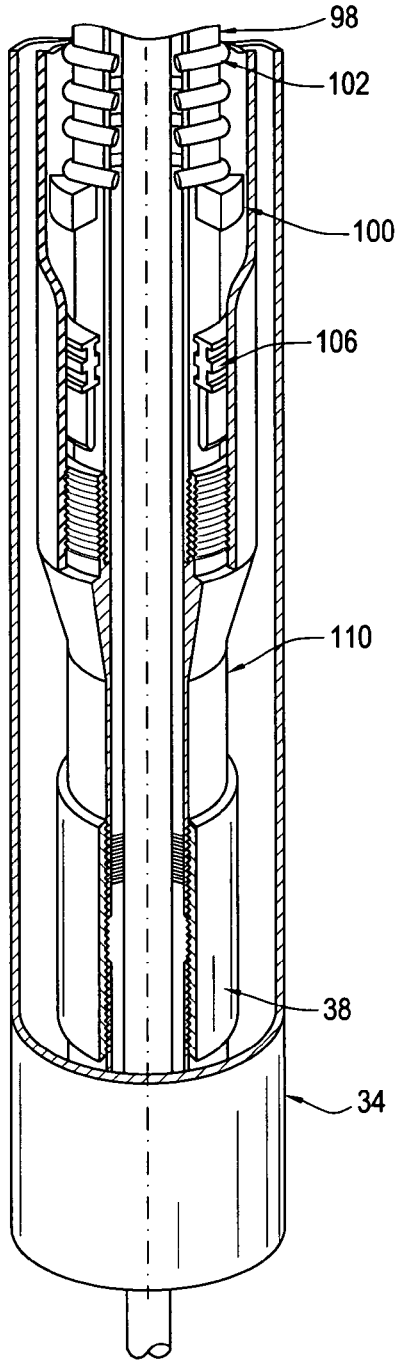

The system of FIGS. 7 to 9 transmits downhole fluid status data by sonic impulse transmission of selected frequencies in the fluid along the tubing. Conventional couplers are again incorporated in the tubing string down to the production zone, but below that zone two tubing sections are coupled together by novel sensor and sonic signaling devices 52', 54' positioned at specific levels below the production zone and above the pump 60 as in the example of FIG. 1. The devices 52', 54' cooperate with hammer triggers on the sucker rod string, which are precisely placed to control timing of the signals generated in relation to cycling of the sucker rod. Like the pressure wave system of FIGS. 2-5, the upper sensor and signaling device 52' and the lower sensor and signaling device 54' also support the mass of the lower portion of the tubing 32, as well as the pump 60' which is reciprocated by the sucker rod 36 string. The upper sensor 52' is spaced about 30-50 ft. above the lower sensor 54', which itself is about 18 feet above the plunger pump intake 62 at its lower end. In the example shown the upper and lower sensors 52', 54' are both assumed to be immersed in collected fluid and the fluid interface level is shown at some distance (5500 feet) above the production zone 44. These feature, are in broad senses, comparable to the features in the system of FIGS. 2-5.

Details of the sensing and sonic signal generator devices 52', can be seen in the views of FIGS. 7 to 9. One of the two sensors and signalers 52', 54', which are alike, is therefore described individually and the description is to be understood to be applicable to both. Each includes a trigger actuator (here 56') mounted in a central length of the inner wall of a cylindrical slide hammer (or piston) 170. The slide hammer 170 spans a considerable vertical length, extending down to the compression spring 102. The hammer 170 is longitudinally slidable in a carrier barrel or hammer guide tube section 72 that has threaded ends joining at each end to the top connector 70' which joins to a proximate length of well tubing 32 as seen in FIG. 6A. The guide tube section or barrel 72 receives the slide hammer or piston 170, which slides within the barrel 72 and about the interior anvil 181. O-ring seals 173 enable the slide hammer 170 to move longitudinally between limits as driven by the interior sucker rod 36. An internally projecting actuator sleeve 82' of resilient, long wearing material, is sized to be frictionally engaged and shifted by an interior trigger 56, attached coaxially with the sucker rod mechanism. This is generally comparable to the interior configuration and described in conjunction with the examples of FIGS. 2-5 with some essential differences. Movement of the sucker rod 36 downward engages the large diameter section of the trigger 56' against the resilient actuator sleeve 82', causing the slide hammer to move down as well. The lower edge of the hammer 170 engages and then compresses the coil spring 102 about the lower guide tube section 102 (FIG. 8B). Subsequently, when the sucker rod 36 moves the trigger 56' past the actuator sleeve 82 (or reverses in its cycle), the coiled compression spring 102 is free to drive the slide hammer 170 oppositely (upward). The hammer 170 impacts an annular acoustic generator 180 mounted above and in line with the hammer, 170, which is also annular. The acoustic (sonic) generator 180 is attached to and extends upward from the guide tube section 78, and is also confined within the outer carrier barrel 72 that interconnects to the upper and lower connectors 70', 110 respectively. The carrier barrel 72 forms a housing for the acoustic generator 180, and is threaded into the mating end of the anvil tube 185 at its upper end ultimately via the top and bottom connectors 70' and 110 respectively to the adjacent tubing 32 sections.

One end of the sonic device may include a fluid inlet into the spacing between the carrier barrel 72 and the piston slide tube 98 to enable operation of the pressure equalized piston 106 as previously described in conjunction with FIGS. 2-5. Threaded surfaces or the connectors 70', 110 at the ends of each sensor device 50' or 54' engage to the adjacent tubing 32 sections.

Further details of a sonic or acoustic generator 180 activated by the sucker rod 36 can be noted as seen particularly in the perspective views of FIGS. 8 and 9, depicting the generator in the cocked and fired positions respectively. The sonic generator 180 includes a cylindrical anvil or ring 181 having a striker face 182 opposing the transverse upper end of the hammer 170 and on the opposite end from the energizing spring 102. The striker face 182 is in the form of a shoulder transverse to the sucker rod 36 axis. The anvil 181 also includes a threaded end section attaching it to the top connector 70 at the end of the anvil tube 185 (FIGS. 8A and 9A). On the inner surface of the anvil 181 is a ring-shaped groove or depression forming a mechanical acoustic lens 184 in communication with fluid, if any, at that site, within the annulus between the tubing 32 and sucker rod 36. The lens 184, when the anvil 181 is struck, initiates oscillations at a selected frequency, which is different if there is fluid in the tubing/casing annulus 33 at that elevation than when there is no fluid at that elevation. Thus impact of the slide hammer 170 on the striker face 182 of the anvil 181 generates a selected individual sonic frequency which varies with the particular lens and with whether the production fluid has risen to that elevation.

The acoustic lenses 184 for each of the upper and lower sensors 52', 54' are accordingly selected to be uniquely different for the upper and lower sensors respectively. With the devices 52', 54' properly spaced, pairs of some signals are transmitted along the fluid column in the wellbore to the signal receiver 21 and controller 20 at the wellhead (FIG. 6). The configurations of the cylindrical slide hammer 170, and carrier barrel 72 can be arranged to define an acoustic chamber within the anvil tube 185, to enhance the acoustic signal that is generated on impact.

Details of the cylindrical triggers 56, 57 implanted in the sucker rod 36 string which engage the inwardly protruding piston actuators 82 in the sensor and signaling devices 52', 54' are therefore similar to the actuator elements in the system of FIGS. 2-5. The cylindrical triggers 56' are diametrically dimensioned to engage the protruding surfaces of the associated piston actuator 82, so as to impel lengthwise movement, compacting the compression spring 102. Then when the sucker rod cycles further downward through its much larger span of movement, the spring 102 is released, and drives the slide hammer 170 forcefully against the striker face 182 of the anvil 181. To reduce fluid resistance against lengthwise movement, the trigger 56' may include longitudinal fluid transfer holes (not shown).

An example of the operation of the system of FIGS. 7-9 is provided with reference to typical conditions in the wellbore under different states of operation. Assume that the oil bearing zone 44 has fed oil through the perforations 48 in the casing 34 and that the fluid level has stabilized at a depth of 5200 ft. or approximately 500 ft. above the perforations in the oil bearing zone. Under these conditions, the oil bearing zone pressure will be compensated (in this example) by the static fluid level. With the pump 60 operating, however, the withdrawal of oil from the annulus provides an output flow through the tubing 32 to the wellhead, reducing the static fluid level. At this point, both sensors 52', 54' which are positioned above the intake 62 of the pump 60 are immersed in fluid and the controller 20 requires pumping to reduce the oil column until the level is below the perforations 48, here at an assumed depth of 5700 ft. The reduction in fluid column height lowers the back pressure on the oil bearing zone, which therefore flows at a faster rate. When the fluid level in the column is below the production zone 44, there is no back pressure against the fluid intake, and the formation flows at a higher rate, closer to the maximum possible.

In the present system, production can be maximized by use of the real time detection of fluid presence at two different elevations above the pump intake 62. When the upper level is below the fluid level, the signal patterns are substantially constant. When the fluid level, however, drops below the upper sensor 54', the pump 60 velocity can be decreased, using the level indication received at the wellhead receiver 21 and provided to the controller 20. Subsequently, the pumping rate can be lowered by reducing the pumping velocity. Ideally the pumping rate will be at a long term level which maintains the upper level of fluid somewhere between the two sensors 52', 54' above the pump intake 62. Given the variations in flow rates and pumping conditions that can apply, this stabilized condition is not likely to exist as a practical matter for a substantial length of time. However by using software which attempts to estimate pumping rates needed to match output production, settings may be arrived at that provide maximized flow over a period of time.

The controller 20 of FIG. 6 may also incorporate, in its prescribed calculations, to maximize rates, data from the flow meter 26 and change of status indications from the POC detector 25 of the Pumped Off condition. Bearing in mind that the production from a given zone may vary considerably with time, sensors which are set to maximize the petroleum flowing from the production zone between reasonable limits for a long period of time can properly be said to maximize production.

The propagation velocity of sonic impulses in petroleum is about 5 times faster than in air, so there is true real time operation even in wells of substantial depth. Air and gas mixed into the fluid column do not significantly slow or attenuate the signal.

It should be appreciated that these examples disclose systems and methods for remotely signaling the fluid level within a petroleum production site, using available energy sources only and requiring foreknowledge for installation only of production zone levels. Methods and apparatus in accordance with the invention can incorporate transducers which respond to the presence or absence of fluid at their elevation to generate a transmission, that carries to the wellhead any may be detected. The detectable energy may comprise a pressure impulse, an acoustic frequency or some variant of that may be initiated locally, transmitted through fluid and identified remotely.

The invention claimed is:

1. A system for monitoring pumping conditions in a petroleum well, said system comprising in combination:

at least one signaling device interposed at an intermediate position in coextensive strings of sucker rod and tubing;

the signaling device including a trigger element, mounted in the sucker rod string and movable therewith throughout its reciprocation span;

a piston element encompassing the trigger element and spaced therefrom;

a cylinder about the piston element and attached between tubing sections, the cylinder retaining the piston element in sliding relation;

a resilient sleeve coupled to the interior of the piston and dimensioned to resiliently and peripherally engage the trigger element as the trigger element reciprocates with the sucker rod, the length of the sleeve being short relative to the reciprocation span of the sucker rod;

a compression spring engaging the bottom end of the piston and coupled fixedly to the cylinder at its lower end;

the piston being driven down against the compression spring by the trigger element and released when the trigger element slides through the sleeve;

wherein the sensor element also includes an impact element configured to generate a signal transmissible in fluid to the wellhead when impacted by the piston, the signal differing when the signaling device is in the presence of fluid relative to when there is no fluid.

2. A system as set forth in claim 1 above, wherein the impact element includes means defining a chamber about the piston for receiving the impact of the piston, the chamber including fluid inlets open to the accumulated petroleum from the production zone.

3. A system as set forth in claim 1 above, wherein the impact element comprises an element including an acoustic frequency emitting groove operative on impact.

4. A system for transmitting signals from downhole locations in a petroleum well as to the presence of liquid at elevations below the production zone, wherein the system pumps a column of liquid up from below the production zone through a tubing string that encompasses a reciprocating sucker rod, comprising:

at least one sensor section having a length substantially shorter than the reciprocation span of the sucker rod interposed in the sucker rod string below the production zone elevation, said sensor section comprising a cylindrical trigger element mounted along the central axis of the sucker rod and reciprocable therewith, the trigger element having a predetermined outer diameter for a selected length;

the sensor section including a hollow cylindrical barrel concentric with the sucker rod axis about and at least coextensive in length with the trigger element, the barrel being fixed longitudinally relative to the tubing;

a hollow cylindrical piston slidable in the barrel and at least partially coextensive with the trigger when in alignment;

a resilient actuator sleeve element secured circumferentially within the signal piston and having an inner diameter sized along a part of its length of engage the outer diameter of the trigger element and dimensioned and structured to deform responsively in response to movement of the trigger therethrough as the sucker rod reciprocates;

a compression spring coaxial with the sucker rod and disposed to engage the piston at its upper end and the barrel at its lower end to compress momentarily under sucker rod motion and to drive the piston upwardly when the trigger element is released;

the signal piston being slidable in the barrel and the spring being compressed by downward movement of the sucker rod during engagement of the trigger element, the resilient actuator element;

a signal emitter positioned adjacent and above the piston and spaced therefrom to be engaged by the piston when released from the trigger after it passes through the actuator element, and the piston is driven upward by the compression spring to impact the signal emitter, and a flow arrangement coupling liquid from exterior to the tubing into the path of the piston to modify the impact.

5. A system as set forth in claim 4 wherein said signal emitter comprises a pressure wave generator actuated by the upper end of the signal piston.

6. A system as set forth in claim 5 above wherein the pressure wave generator comprises an impact surface, said surface defining part of a shock wave chamber and said generator including ports therein establishing flows which blunt the impact of the piston dependent on the presence or absence of fluid.

7. A system as set forth in claim 4 above, wherein the signal emitter comprises a signal anvil having an impact face that is engaged by the piston when released, the anvil including a groove therein generating a sonic signal at a selected frequency when impacted.

8. A system as set forth in claim 4 above wherein the system also includes top and bottom connectors coupling the top and bottom ends of the sensor section to the adjacent ends of the tubing.

9. A system as set forth in claim 8 above, wherein the sensor section further includes fixed lugs extending radially from the barrel and engaging the bottom of the compression spring and a piston slide tube interior to the piston and in fixed relation to the carrier barrel, and pressure equalizing piston elements below the piston and between the carrier barrel and the piston slide tube.

10. A system as set forth in claim 9 above, wherein the trigger element has different diameters along its length and the trigger element spacing relative to the sensor structure provides sufficient clearance for the passage of signal indicating perturbations along the column of fluid within the tubing.

11. A signaling element for petroleum wells which can be interposed at a selected elevation in a sucker rod string to use the reciprocation of the sucker rod string to signal through the fluid column in the tubing to the wellhead, as to whether there is petroleum collection in that level in the tubing/casing annulus, comprising:

a hollow connecting coupling between two adjacent tubing elements concentric about the sucker rod axis that are to be joined;

a central element along the sucker rod axis and concentric with the hollow connecting coupling, the central element having a varying diameter and being joined to and movable with the sucker rod;

a piston surrounding the sucker rod axis and slidable in the coupling;

an actuator element within the piston and secured thereto, the actuator element being dimensioned to receive and resiliently retain the central element for a limited length of travel of the sucker rod;

a spring mounted in the coupling in engagement at one end of the piston driving the piston up when the central element is free of the actuator, and a signal emitter receiving fluid from exterior to the tubing, the signal emitter being positioned above the piston to be engaged by the piston when released.

12. A method of remotely indicating the presence or absence of collected petroleum along a petroleum column from at least one selected downhole level, below a production zone and above a sucker rod driven pump, utilizing the energy of a reciprocating sucker rod string that has a substantial reciprocating span, comprising the steps of:

installing at least one spring-loaded mechanically triggered device having a much shorter triggering span than the reciprocating span of the sucker rod string;

using the energy of the sucker rod string to spring load the at least one installed device and thereafter release the device;

generating an impact on release of the installed device, and transferring signal energy along the column of fluid in the tubing which varies to indicate the presence or absence of collected fluid at the downhole elevation.

13. A method as set forth in claim 12 above, wherein impact generating devices are located at two different elevations between the production zone and the pumping zone, and further including the step of using signals from the two sensors to determine the rate of pumping, so as to vary the rate to increase the flow rate over a period of time.

14. A method as set forth in claim 12 above, wherein the signal energy that is transferred is a pressure wave in the petroleum.

15. A method as set forth in claim 12 above, wherein the signal energy that is transferred is an acoustic transmission in the petroleum.

16. A method of using impact capable fluid responsive devices in a system to respond to fluid conditions at different downhole elevations below an oil producing zone in a petroleum well, using a reciprocating sucker rod system to improve production in the use of pumping equipment comprising the steps of:

installing at least one spring loaded impactable fluid responsive device in the sucker rod string at least one selected elevation zone below the production zone level and above the pumping level in the well;

where fluid has been collected at the selected elevation zone about the column of fluid, feeding fluid therefrom into the fluid responsive device;

using the reciprocating action of the sucker rod to load and then release the at least one device to provide a signal indication as to the presence or absence of fluid at that elevation;

transmitting the signal indication through the column of fluid in the well to the wellhead, and using the received signal indication at the wellhead to effect changes in the pumping operation.

17. A method as set forth in claim 16, further including the step of installing two spring loaded impact capable devices in the sucker rod string at different elevations below the production zone and above the pumping level, and further including the steps of computing the rate of withdrawal of fluid from the well and varying the pumping rate in response thereto to seek to maximum the rate of production over time.

18. The method of claim 17 above, including the steps of monitoring the pumping rate and shutting down the pumping operation before the pumped off condition arises.

19. The invention as set forth in claim 17, including the step of transmitting a signal indication as a pressure wave through the column of fluid to the wellhead.

20. A method as set forth in claim 17 above, including the step of transmitting an acoustic signal to the wellhead which varies in frequency dependent upon the presence or absence of fluid at the sensing level.

21. A method as set forth in claim 17 above, wherein the sensor device is installed at a predetermined level between the production zone and the pumping equipment, and the method further includes the step of effecting changes in the pumping operation by using externally derived indications of pumping status.

* * * * *